United States Patent [19]

Vidal

[11] Patent Number: 4,688,787

[45] Date of Patent: Aug. 25, 1987

[54] CAPTIVE FLIGHT DEVICE

[76] Inventor: Daniel I. G. Vidal, Bulevar Artigas 1193, Montevideo, Uruguay

[21] Appl. No.: 780,106

[22] Filed: Sep. 25, 1985

[51] Int. Cl.[4] ..... A63H 27/04; A63H 13/20

[52] U.S. Cl. ..... 272/31 A; 446/30

[58] Field of Search ..... 446/33, 31, 30, 232, 446/247, 230, 57, 59; 272/31 A, 31 B

[56] References Cited

U.S. PATENT DOCUMENTS

| | | | |
|---|---|---|---|
| 2,521,620 | 9/1950 | West et al. | 273/31 A |
| 2,837,864 | 6/1958 | Bortfeldt | 446/33 |
| 3,919,805 | 11/1975 | Stanzel | 446/33 |
| 4,398,370 | 8/1983 | Allen | 446/31 |

*Primary Examiner*—Mickey Yu

*Attorney, Agent, or Firm*—Beveridge, DeGrandi & Weilacher

[57] ABSTRACT

A device for the captive flight of a propeller-driven model airplane is disclosed. The device having a fixed arm with a pulley mounted on the free end thereof, a swingable arm with a motor mounted on the free end thereof, a cable attached to the motor and to the propeller via a transmission unit for transmitting power to the propeller, and a toric ring fixed with respect to the fixed arm. The cable is threaded over the pulley and through the toric ring between the motor and the airplane. As the motor is moved by the swingable arm with respect to the pulley and the toric ring, the effective length of the cable between the toric ring and the airplane is shortened or lengthened to control the trajectory of the airplane.

6 Claims, 4 Drawing Figures

CAPTIVE FLIGHT DEVICE

(1) CONCEPT

The present invention refers to a novel combination of known elements enabling captive flight of model airplanes, lacking on board power sources, to achieve realistic flight and to provide variable-radius flight paths.

(2) PRIOR ART

At present, there are three classes of captive flight model airplanes: (a) those having propeller driving motor means inside the plane and using one or more cables with the sole purpose of controlling the flight; (b) those having the propeller driving means inside the plane and using one or more cables for supplying energy to the propeller driving means and for controlling the flight; and (c) those attached to a liner wherein the cable transmits the rotary motion of an external propeller driving means to the propeller of the model plane.

(3) NOVELTY

The innovation introduced by the present invention is particularly effective in very small scale model airplanes and comprises the use of only one cable, of very small diameter compared to the size of the plane, in order to perform the functions that as set forth in subclause (c) above, are provided separately by the liner forming a unit with the plane and the transmitting cable rotating therein. Since the present invention comprises only one cable, of very small diameter, the cable is barely visible and thus the present invention provides the desired realism of independent flight.

Further, the present invention provides means for increasing and decreasing the radius of the path of the plane during flight. The technical advantage of the present invention resides in the fact that the cable performs the dual function of fastener and power transmitter in such a way that the centripetal and torsional forces normally bearing upon the plane are prevented from affecting the normal operative condition of the plane, even when the radius of its circular trajectory is altered during flight. The captive flight device of the present invention achieves this result by: (a) reducing the inertia in the transmission system in such a way that the centripetal force tending to alter the course of the plane from its normal path is counteracted by stronger forces exerted by the motion of the plane and (b) shifting the angle of the propeller so that the force exerted by the same due to this shift may neutralize the torsional force tending to modify the normal angle of attack of the plane.

(4) DESCRIPTION OF A PREFERRED EMBODIMENT OF THE INVENTION

To more easily understand the following explanation, several drawings based upon an embodiment of the present invention are attached. The drawings are intended to represent only one embodiment of the present invention and thus they are not intended to limit the scope of the invention claimed herein.

Figure 1:
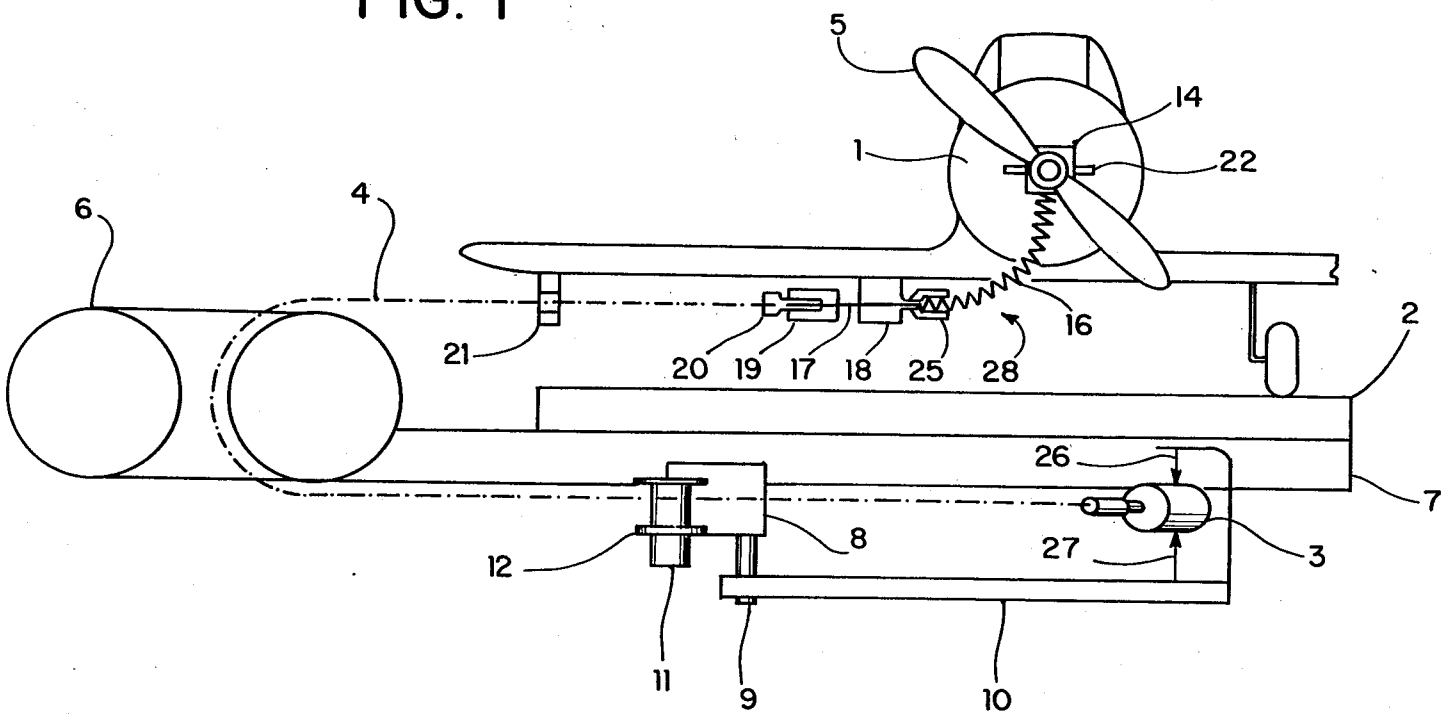
FIG. 1 depicts the principal elements constituting an embodiment of the present invention.
Figure 2:
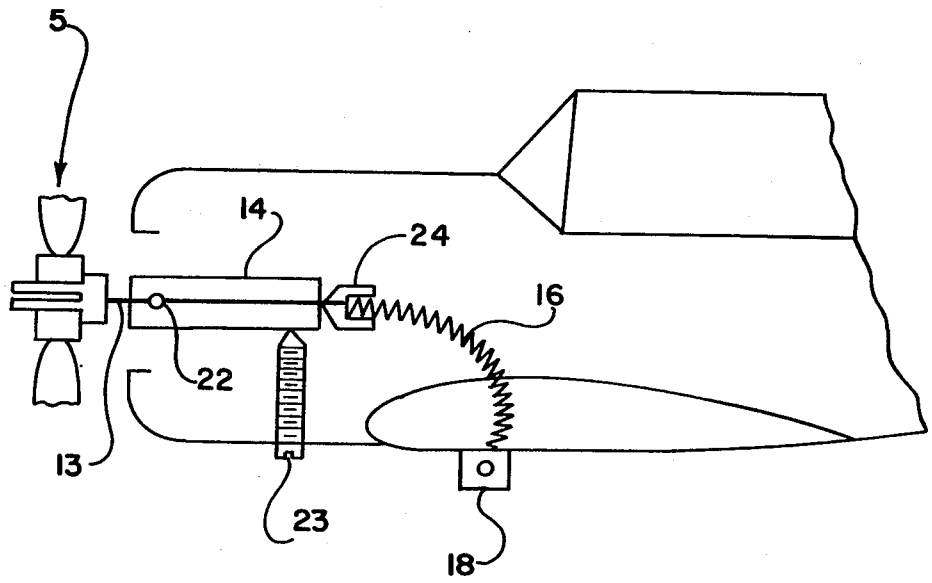
FIG. 2 is a cut-away, fragmentary view showing the transmission device mounted in the model airplane and the propeller angle correction device.
Figure 3:
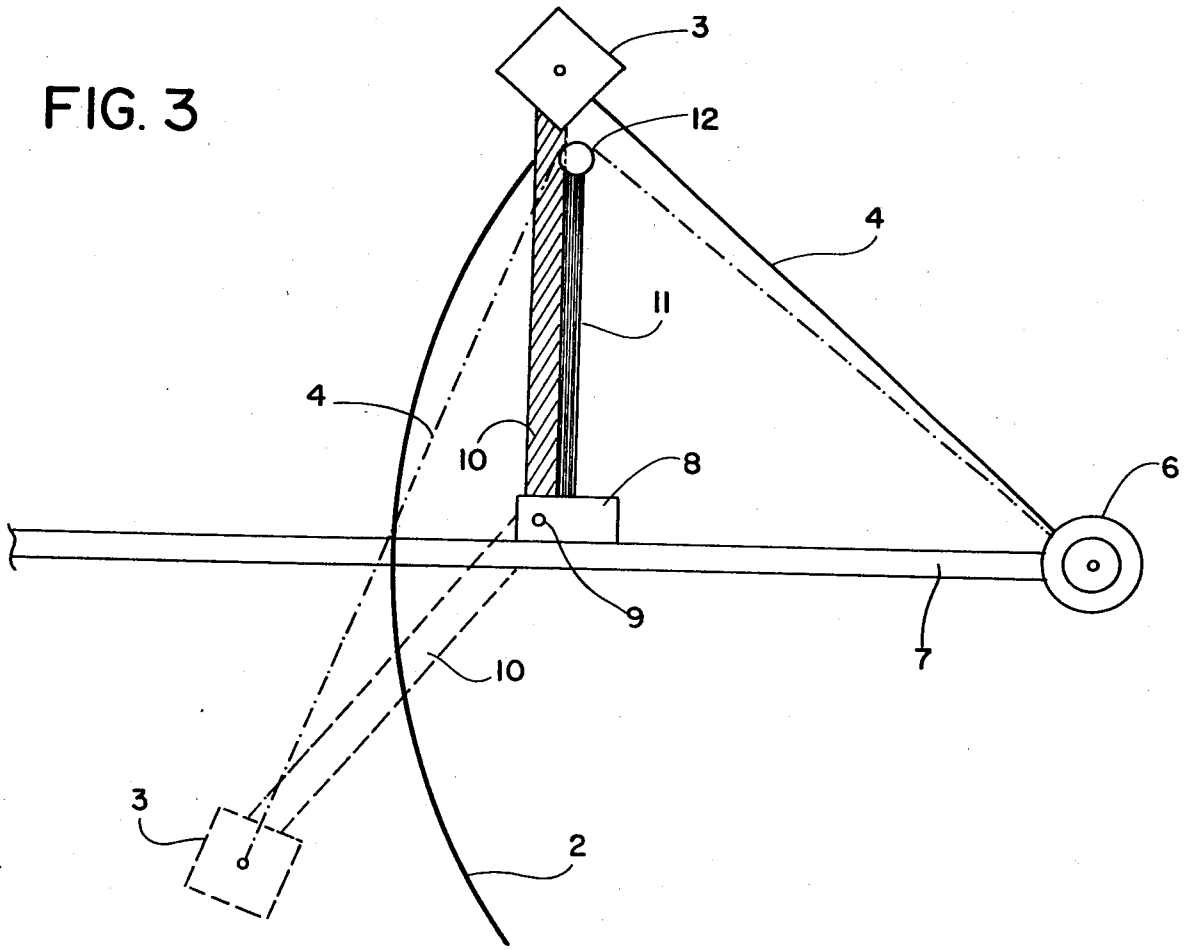
FIG. 3 depicts a system for increasing and/or decreasing the radius of the path of the plane.

In particular, the embodiment shown in FIGS. 1-3 comprises a model airplane (1) having take off and landing capabilities on circular track (2). Model airplane (1) is propelled by an electric motor (3) and a cable (4), transmitting the rotary motion from motor (3) to the propeller (5) by means of transmitting device (28) mounted on plane (1). As can best be seen in FIG. 1, cable (4) passes through the open central portion of toric ring (6). Thus ring (6) operates as a pulley with respect to cable (4) and ring (6) is placed in a coaxial position with respect to the axis of circular track (2). Midway in the radial part (7), of one of the parts supporting the track, there is a mechanism (8) and a moving arm (10) pivotable about the axis (9) of mechanism (8). Motor (3) is mounted at the free end of moving arm (10). Fixed arm (11) is fixed perpendicular to radial part (7) and above and parallel to moving arm (10) as shown in FIGS. 1 and 3. Fixed arm (11) supports a pulley (12) at a position in alignment with cable (4) extending from motor (3). Thus as moving arm (10) moves along a curved path corresponding to track (2), it moves from the position shown in solid lines in FIG. 3 to the position shown in dotted lines in FIG. 3 so that pulley (12) receives cable (4), thereby decreasing the radius of the flight path such as for example, to prepare for the landing of plane (1).

Mounted in plane (1), transmitter device (28) comprises a drive shaft (13), adapted to rotate within movable bushing (14) for driving propeller (5). At its opposite end, shaft (13) is connected to helicoidal flexible wire (16). Shaft (17), journaled within fixed bushing (18) connects to the other end of wire (16) by means of shell-like washer (25). Female connecting piece (19) in turn receives the opposite end of shaft (17) and detachably receives top piece (20) which crowns the end of cable (4), after cable (4) is passed through guide (21). Moving bushing (14) is pivotable at fixed point (22) and is supported at one end of screw (23) as shown in FIG. 2. Due to the action of helicoidal flexible wire (16) bushing (14) bears against screw (23).

Each end of helicoidal flexible wire (16) is inserted in one of shell-like washers (24) and (25) serving as top elements against bushings (14) and (18) determining the resting points for the force exerted by propeller (5) and the force exerted by the captive motion of the plane. Motor (3) is mounted between points (26) and (27) which determine its rotating axis and conduct electric power to it. Preferably the transmission system components have the minimum mass required and work with minimal friction.

(5) OPERATION OF THE PREFERRED EMBODIMENT

Once the plane is on the track and the motor has been started, the cable, the other elements of the transmission system and the propeller begin to turn. When the speed of the motor increases, the plane starts its taxiing, then speeds up, and takes off In FIG. 4, pulley 100 is movable rather than fixed as is pulley 12 in FIGS. 1 and 3. Pulley 100 is movable in the directions indicated by arrows A and B. Pulley 100 receives cable 102 from driving device 104. Cable 102 and device 104, as is toric ring 106 are of the same type as cable 4, electric motor 3 and toric ring 6 as shown in FIGS. 1–3. held by the cable that accompanies the flight. At all times the plane exerts a centrifugal force on the cable sliding on the internal and upper side of the central toric ring, stronger than the force the cable exerts on the plane. Moreover, torsion effect is neutralized by a selected angle given to the propeller with respect to the advancing aerodynamic axis of the plane, by adjustment of screw (23).

(6) MODIFYING FLIGHT RADIUS

Figure 4:
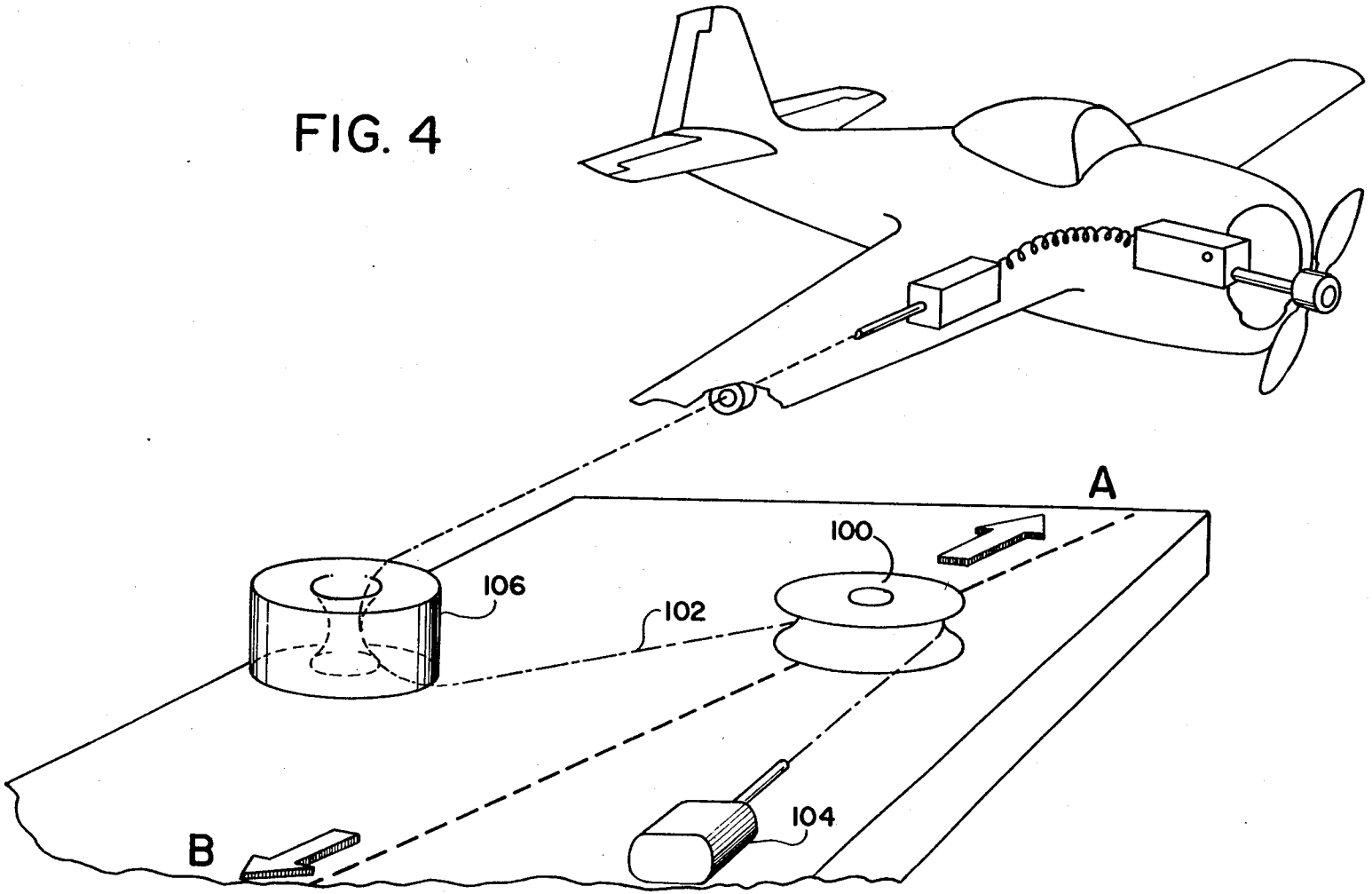
Figure 4 depicts a captive flight device having a reciprocally movable pulley in accordance with the present invention.

Once the plane has taken off, moving arm (10), operated by mechanism (8), may be moved radially towards toric ring (6) to extend the length of cable (4) fastened to the plane. The tension of cable (4) maintains the axis of the motor (3) in orientation towards toric ring (6). Moving arm (10), may be used in combination with pulley (12) placed in a fixed position that can be surpassed by motor (3) in its progression toward and away from toric ring (6) with the purpose of increasing or decreasing the length of the cable emerging from ring (6) and, consequently, increasing or decreasing the radius of the flight. In FIG. 4, pulley 100 is movable rather than fixed as is pulley 12 in FIGS. 1 and 3. Pulley 100 is movable in the directions indicated by arrows A and B. Pulley 100 receives cable 102 from driving device 104. Cable 102 and device 104, as is toric ring 106 are of the same type as cable 4, electric motor 3 and toric ring 6 as shown in FIGS. 1–3.

I claim:

1. A captive flight device for a propeller-driven model airplane having external propeller driving means comprising:

driving means, located externally of the model airplane, for driving the propeller;

a cable for defining the trajectory of the plane and transmitting power from the driving means to the propeller;

a toric ring, located between the driving means and the plane, for receiving said cable through the central portion thereof, said ring having an inner surface, a lower surface and an upper surface for contacting said cable extending therethrough;

power transmission means on board the plane for coupling said cable to the propeller, said power transmission means including a pivotable support member, means for pivoting said support member, and a low inertia, flexible member, said support member having a drive shaft connected to the propeller at one end of said drive shaft and to said low inertia member at the other end thereof, said support member selectively pivoting the propeller.

2. A captive flight device as claimed in claim 1 further comprising trajectory control means for selectively increasing or decreasing the radius of the path of flight of the plane, said control means including a fixed arm having a pulley mounted on the free end thereof and a swinging arm pivotally movable in an arc with respect to said fixed arm, said movable arm having a free end carrying the driving means, said arm cooperating to increase the radius of the flight path as said movable arm swings toward said fixed arm.

3. A captive flight device as claimed in claim 1 wherein said low inertia, flexile member comprises a helicoidal, flexible wire.

4. A captive flight device as claimed in claim 3 further comprising a second drive shaft disposed between said cable and said wire for transmitting rotational movement from said cable to said wire.

5. A captive flight device, as claimed in claim 1, further comprising trajectory control means for selectively increasing or decreasing the radius of the path of flight of the captive plane, by means of the shortening of the elongation of a section of said cable extending from the driving means to the opening in the toric ring.

6. A captive flight device, as claimed in claim 1, wherein said means for pivoting said support member comprises an adjustment screw.

* * * * *